US008816792B2

(12) United States Patent
Antkowiak et al.

(10) Patent No.: US 8,816,792 B2
(45) Date of Patent: Aug. 26, 2014

(54) HIGH POWER, LOW-PASSIVE INTERMODULATION MICROWAVE TERMINATION

(75) Inventors: Marek E. Antkowiak, Berkeley Heights, NJ (US); Carl Schraufnagl, Boontoon, NJ (US)

(73) Assignee: R & D Microwaves LLC, East Hanover, NJ (US)

( * ) Notice: Subject to any disclaimer, the term of this patent is extended or adjusted under 35 U.S.C. 154(b) by 842 days.

(21) Appl. No.: 12/688,311

(22) Filed: Jan. 15, 2010

(65) Prior Publication Data

US 2011/0175690 A1 Jul. 21, 2011

(51) Int. Cl.
*H01P 1/26* (2006.01)

(52) U.S. Cl.
CPC . *H01P 1/266* (2013.01); *H01P 1/26* (2013.01)
USPC ..... 333/22 R

(58) Field of Classification Search
USPC ..... 333/22 R, 22 F
See application file for complete search history.

(56) References Cited

U.S. PATENT DOCUMENTS 6,326,862 B1 * 12/2001 Ferguson et al. ..... 333/22 R

* cited by examiner

*Primary Examiner* — Stephen Jones
(74) *Attorney, Agent, or Firm* — Stroock & Stroock & Lavan LLP

(57) ABSTRACT

A termination configured to absorb high microwave power while generating low levels of passive intermodulation interference. The termination includes a microwave cable having a first end and a second end providing an insertion loss from the first end to the second end, a heat-dispersive element in thermal contact with at least a portion of the microwave cable, a channel accommodating the microwave cable, and an input connector coupled to the proximal end of the microwave cable. Optionally, one or more plates having grooves to accommodate the microwave cable may be provided between the heat-dispersive elements.

15 Claims, 7 Drawing Sheets

PLATE 1

PLATE 2

SECTION A-A

CONNECTOR PLATE

HIGH POWER, LOW-PASSIVE INTERMODULATION MICROWAVE TERMINATION

Numerous references including various publications may be cited and discussed in the description of this invention. The citation and/or discussion of such references is provided merely to clarify the description of the present invention and is not an admission that any such reference is "prior art" to the present invention. All references cited and discussed in this specification are incorporated herein by reference in their entirety and to the same extent as if each reference was individually incorporated by reference.

FIELD OF THE INVENTION

Embodiments of the present invention relate to microwave devices. More specifically, embodiments of the present invention relate to a microwave termination that can be used during microwave testing of a device-under-test ("DUT"), without significant effect upon testing of the DUT.

BACKGROUND OF THE INVENTION

Testing of microwave devices often involves passing a high-power microwave signal through a device or system under test ("DUT"), and recording the response of the DUT to changes in the signal or to changes in the configuration of the DUT. For instance, a frequency response of the DUT may be obtained by passing a microwave signal through a device and sweeping the signal throughout a frequency range. Or, linearity of an amplifier may be measured by passing a microwave signal at a known frequency through a DUT, and adjusting the input power of the microwave signal through a known power range while monitoring the output power.

When testing, it is desirable to minimize artifacts caused by test fixtures, and to calibrate the test fixture so that any remaining data artifacts caused by test fixtures can be minimized or eliminated in the measured data. One technique is to connect the output of the DUT to a microwave termination, typically having an impedance matched to 50 ohms. Such an impedance of the termination will reduce reflections caused by an impedance mismatch between the DUT and the termination. Energy absorbed by the microwave termination is dissipated as heat.

In other situations, when stopping the delivery of microwave power temporarily, it may be desirable to shunt a microwave signal to a load rather than to turn off temporarily the microwave source. For instance, some microwave sources such as a traveling wave tube amplifier ("TWTA") are known to require a warm-up time to achieve full rated performance. Therefore, turning off such a microwave source may affect how quickly the source can be turned back on. Furthermore, a temporary open circuit may cause power reflections that damage the microwave source. Instead, when stopping the delivery of microwave power, the power can be shunted to a microwave termination while the microwave source remains active.

Testing at high microwave powers presents certain engineering challenges. Nonlinear effects generally become relatively more pronounced as the input power increases. For instance, it is well known that passive intermodulation products may be formed in a passive microwave device, in which an input microwave signal having two or more frequency components may generate spurious output signals having frequencies that are at sums and differences of multiples of the frequencies of the input signals. As the power of the input signal increases, the power of the spurious signals increases at a faster rate. Therefore, it is desirable to provide a microwave termination suitable for use in high power microwave usage.

SUMMARY OF THE INVENTION

The present invention is directed to a high-power microwave termination that exhibits improved passive intermodulation performance. The termination provides high power handling capability in a compact device, with reduced impact to upstream devices caused by intermodulation products.

A device in accordance with an embodiment of the present invention preferably includes one or more of the following assembly design features or functions: a quantity of a power-absorbing material that is made from materials that promote low-intermodulation generation; a shape of the power-absorbing material preselected to provide a desirable combination of compactness and low intermodulation generation; and a heat dissipater. The heat dissipater substantially conforms to the size and shape of the power-absorbing material.

The foregoing is a summary and thus contains, by necessity, simplifications, generalization, and omissions of detail; consequently, those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In an embodiment, the present invention provides a termination configured to absorb high microwave power while generating low levels of passive intermodulation interference. The termination includes a microwave cable having a proximal end and a distal end providing an insertion loss from the proximal end to the distal end, a heat-dispersive element in thermal contact with at least a portion of the microwave cable, a channel accommodating the microwave cable, and an input connector coupled to the proximal end of the microwave cable. Optionally, one or more plates may be provided between the heat-dispersive elements.

BRIEF DESCRIPTION OF THE DRAWINGS

The following detailed description refers to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

DETAILED DESCRIPTION OF THE INVENTION

Traditional microwave terminations include a power absorbing element to dissipate the microwave energy while minimizing energy that is reflected back to the source, the minimized energy being at frequencies that may include the primary carrier frequencies or intermodulation frequencies. The present invention is directed to a microwave termination capable of higher power absorption and lower intermodulation generation. The higher power absorption is achieved by improved dissipation of heat generated by the microwave energy that is absorbed. The lower intermodulation generation is achieved by selection of materials and selection of routing geometry for the power absorbing element as described herein. The power absorbing element may include a power absorptive cable.

One or more embodiments of the present invention is capable of absorbing microwave energy in the frequency range from about 700 MHz or less, up to about 8,000 MHz or greater. One or more embodiments of the present invention is capable of absorbing a microwave power of 1,000 watts average and 6,000 watts peak. One or more embodiments of the present invention is capable of producing third order passive intermodulation products no greater than −160 dBc relative to two continuous wave carriers of +43 dBm each that are injected at an input port of the embodiment. One or more embodiments of the present invention provides an input impedance of 50 ohms. One or more embodiments of the present invention provides a maximum voltage standing wave ratio (VSWR) of 1.20 within the frequency range of about 1.0 GHz to about 8.0 GHz.

Figure 1:
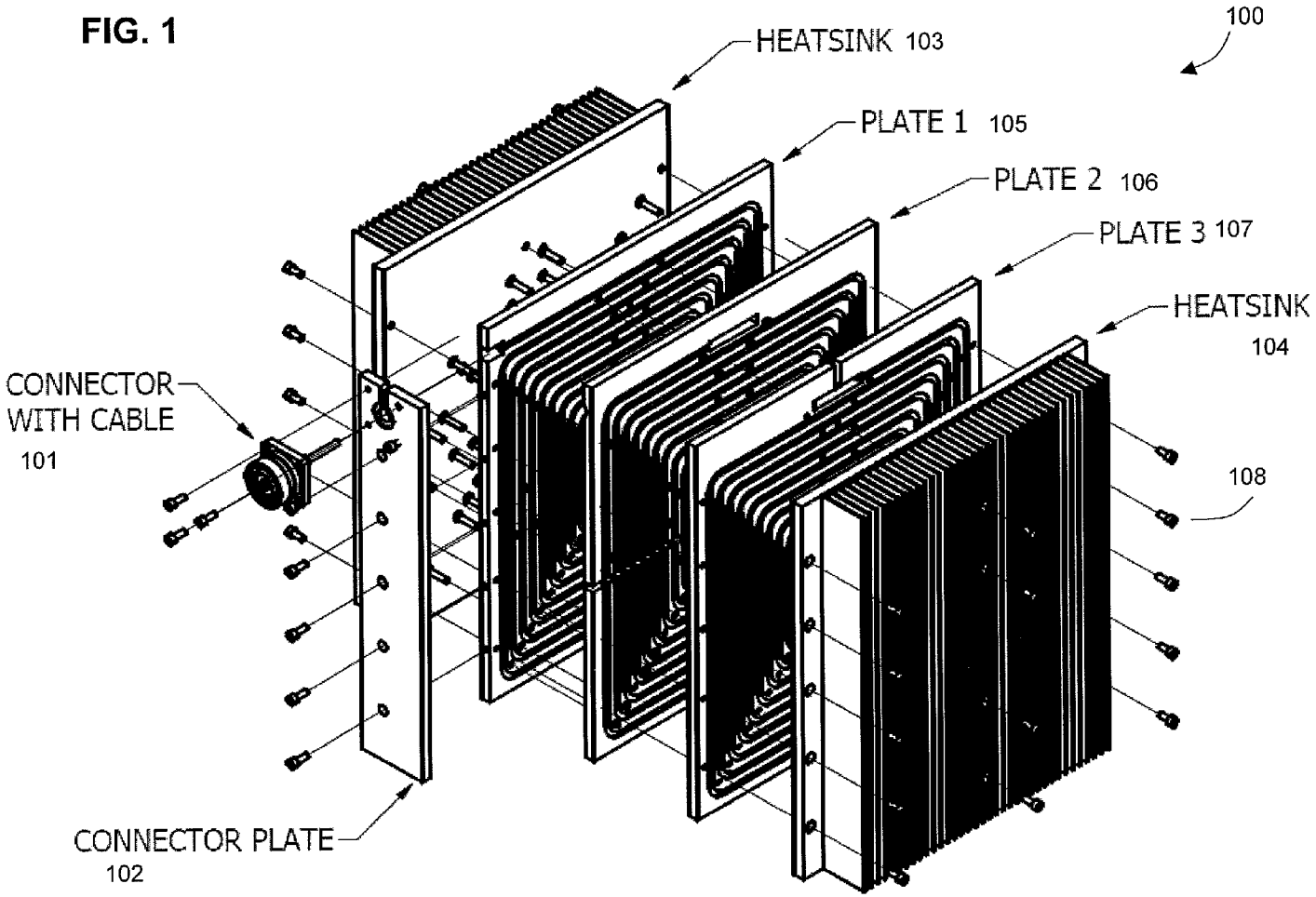
FIG. 1 is an exploded perspective view of an embodiment of the present invention.

Referring now to FIG. 1, the absorptive cable within microwave termination 100 preferably has a high amount of total surface area contact within microwave termination 100, thereby providing a high level of thermal transfer from the absorptive cable to the plates (if provided) and heat sinks per unit length of absorptive cable. Embodiments of the present invention provide a high amount of total surface area contact by enveloping the absorptive cable along substantially its entire girth for substantially the entire length of the absorptive cable within the housing 5.

Further, the microwave termination 100 is designed to avoid generating passive intermodulation products ("IMs"). Passive IMs can be facilitated by an interface between certain dissimilar materials. Passive IMs may also be generated by sharp kinks or bends in the conductor carrying the microwave energy, and by surface defects such as pits or burrs which would tend to concentrate the electric field of currents passing through the absorptive cable.

Further design techniques that minimize the formation of passive IMs may include: minimizing the number of contact junctions; designing all contact junctions such that they are precise and under sufficient pressure to maintain good contact; solder or cold weld all junctions where possible; plate all surfaces to prevent oxidation to ensure that plating is uniformly applied and of sufficient thickness. Further to these design techniques, the interface from the connector to the absorptive cable is designed to be mechanically stable, because small movements caused by flexing can be translated into passive IMs.

Manufacturing deficiencies which promote passive IMs, and therefore are to be avoided, may include: poor alignment of parts; inadequately torqued screws and fasteners; bad solder joints; insufficient or incomplete cleaning of parts prior to plating; contaminated plating tanks; plating material build-up; using wrong materials; and poor plating adhesion.

Environmental factors may also contribute to passive IM generation. Such factors can include: wind-induced vibration, temperature variations (e.g., from usage, or from thermal loading by the sun); moisture in its various forms; and air-borne dirt.

The braided outer conductor of the absorptive cable is constructed from a material that provides low-PIM performance. The braided outer conductor may preferably include copper, silver, Teflon® (chemical name polytetrafluoroethylene or polytetrafluoroethene) or tin-plated braided shield. The inner conductor is preferably silver-plated solid copper wire, but other materials such as aluminum may also be used. Dissimilar materials such as nickel, steel and ferrous-based materials are known to promote the generation of passive IMs and should therefore be avoided. Care of workmanship is exercised in order to avoid scratches and contaminants at the connector and the solder joint to the connector.

FIG. 1 shows an exploded perspective view of an embodiment of the invention. There is shown a microwave termination 100 having an input connector 101 of a standard design, such as 7/16 DIN female connector (i.e., inner contact diameter of 7 mm, and outer contact diameter of 16 mm), or N-type, etc. The input connector 101 is mounted onto connector plate 102 which forms one side of microwave termination 100. The input connector 101 mates on the exterior of microwave termination 100 to a microwave cable bearing microwave energy to be terminated. On the interior of microwave termination 100, input connector 101 is connected to an absorptive cable (not shown). The microwave energy is generally in the frequency range of about 700 MHz to about 8,000 MHz. The input impedance of the device is designed to be 50 ohms.

Microwave energy absorbed by the microwave termination 100 is converted into heat by the absorptive cable. The microwave termination 100 includes first and second heat sinks 103, 104, respectively, in thermal contact with the absorptive cable, and forming first and second major lateral portions of the microwave termination 100. Heat sinks 103, 104 facilitate shedding of excess heat generated by the microwave termination 100. The embodiment of FIG. 1 illustrates that the heat sinks 103, 104 include a plurality of cooling fins provided on exterior major lateral surfaces of microwave termination 100. The cooling fins are generally arranged vertically to promote natural convection, however other orientations may also be used. A forced air apparatus (not shown in FIG. 1) may be used together with the heat sinks 103, 104 in order to increase the dissipation efficiency of the heat sinks 103, 104. The cooling fins typically are constructed of aluminum, but may also be made from any material having a relatively high thermal conductivity.

Between first heat sink 103 and second heat sink 104 there may be located one or more plates. The embodiment of FIG. 1 illustrates a first plate 105, a second plate 106 and a third plate 107, respectively, as viewed in the direction from first heat sink 103 to second heat sink 104, plates 105-107 being oriented substantially parallel to heat sinks 103, 104. The number of plates is selected in order to provide a desired amount of power termination capacity. Each plate is in thermal contact with a length of the absorptive cable, such that more plates provide more thermal contact with the absorptive cable and therefore more power termination capacity. The absorptive cable is sized such that when the maximum RF power to terminate is injected into input connector 101, the RF power is substantially entirely dissipated by the absorptive cable before reaching the end of the cable. In the situation where the power is not initially entirely dissipated by the cable, the far end of the cable is preferably open, resulting in a reflective condition so that any RF power not initially dissipated by the cable is reflected back into the cable and further dissipated by the absorptive cable as a reflected signal. The embodiment of FIG. 1 will be described with reference to three plates, but it will be understood that the description applies to other embodiments having a different number of plates, unless the descriptive context clearly indicates otherwise.

A plurality of fasteners 108 are used to hold together the heat sinks 103, 104 and the plates 105-107 such that they are in mechanical and thermal contact with adjacent members of the same. Connector plate 102 is mechanically attached by a plurality of fasteners 108 to at least one of heat sinks 103, 104 or plates 105-107. Preferably connector plate 102 is thermally nonconductive or thermally isolated from heat sinks 103, 104 or plates 105-107 in order to avoid presenting a thermally hot surface to users.

Each of plates 105-107 has formed on at least one major side thereof a spiral groove in the shape of a quadrilateral (e.g., rectangle or square) with rounded corners. An absorptive cable (not shown) is connected to the side of input connector 101 that is interior to microwave termination 100. The spiral groove of first plate 105 starts perpendicular to an edge of first plate 105, at a location directly behind the interior side of input connector 101. The spiral groove of first plate 105 spirals on a major surface of first plate 105 inward toward the center of first plate 105, forming a plurality of turns, and ends at the approximate center of first plate 105. Preferably, the spiral of first plate 105 is located on the major surface of first plate 105 that faces the second plate 106 (if present), thereby allowing the opposite major surface of first plate 105 to be substantially continuous for maximum thermal contact with heat sink 103. The spiral groove is sized to snugly hold and retain the absorptive cable, preferably such that the exposed side of the absorptive cable is substantially flush with the non-grooved portion of the major lateral surface of first plate 105. The snug fit promotes heat transfer from the absorptive cable to first plate 105. A heat-conductive grease, putty, epoxy, or the like may also be provided in the groove in order to promote heat transfer from the absorptive cable to first plate 105.

The number of turns of the spiral groove is selected to provide a predetermined amount of heat transfer from the absorptive cable to the plate, while maintaining a minimum separation between turns of the groove. More turns provides more surface area contact between the absorptive cable and the plate for increased heat transfer. However, if the grooves are too close together then an undesirable amount of heat will be transferred from one turn of the absorptive cable into an adjacent turn of the absorptive cable. For example, the spacing between grooves is preferably approximately three times the diameter of the cable.

In an alternate embodiment, the spiral groove on one plate may be matched to a cooperating spiral groove on an adjacent facing plate, such that when mated the adjacent plates form a channel that holds the absorptive cable.

Sharp bends in a cable may introduce passive IMs. Therefore, the rounded corners of the spiral groove are sized to have a radius of curvature determined by both the minimum bend radius of the absorptive cable, and by a need to avoid introducing passive IMs. For example in an exemplary embodiment, the static minimum bend radius is approximately 8 mm.

At the center of first plate 105, the absorptive cable transitions to the second plate 106. In an alternate embodiment, the cable may transition to a groove on the opposite side of the first plate 105. A quadrilateral spiral groove is located on a major surface of second plate 106. The groove of second plate 106 (i.e., the "second groove") is sized and shaped similarly to the groove of first plate 105 (i.e., the "first groove") except that the second groove begins in the center and spirals outward. The end of the second groove does not necessarily extend to the perimeter of the second plate 106. The second groove is preferably located on the major surface of second plate 106 which is opposite from the major surface facing first plate 105.

Near the outer perimeter of second plate 106, the absorptive cable transitions to the third plate 107, in a manner similar to the transition from first plate 105 to second plate 106. A quadrilateral spiral groove is located on a major surface of third plate 107, preferably the major surface of third plate 107 that is opposite from the major surface that faces second plate 106. The groove of third plate 107 (i.e., the "third groove") is sized and shaped similarly to the first groove, except that the third groove begins near the outer perimeter of third plate 107 at a location matching the end of the second groove, and the third groove spirals in toward the center of third plate 107.

Additional grooved plates, if provided, can interface to third plate 107, providing spiral grooves that alternate from plate to plate from being an outward spiral (as in second plate 106) and an inward spiral (as in third plate 107). In addition to the configuration of the plates and the grooves, the cable is preferably designed and manufactured for low loss, and the loss of the cable is managed via the length and diameter of the cable. Smaller diameter cables exhibit greater loss, and longer cables exhibit greater loss. Accordingly, a cable having a smaller diameter would exhibit greater loss, requiring a shorter cable length. The diameter of the cable chosen typically depends on the amount power input into the termination. In an embodiment, the cable preferably has an insertion loss of approximately 15 dB at lower operating frequencies, yielding a voltage standing wave ratio ("VSWR") of approximately 30 dB. Accordingly, a cable having an insertion loss of 0.25 dB per foot would call for a 60 foot cable. The cable diameter and length may also be varied to achieve the desired insertion loss. Further, in order to achieve improved PIM performance, the configuration of the plates and the grooves allows the cable to be continuous so that it does not have additional connectors besides the connection to the input connector.

Adjacent to the last plate, e.g., third plate 107 of FIG. 1, there is provided a second heat sink 104. Second heat sink 104 is ordinarily designed similarly to first heat sink 103, but other designs may be accommodated.

Figures 2A, 2B:
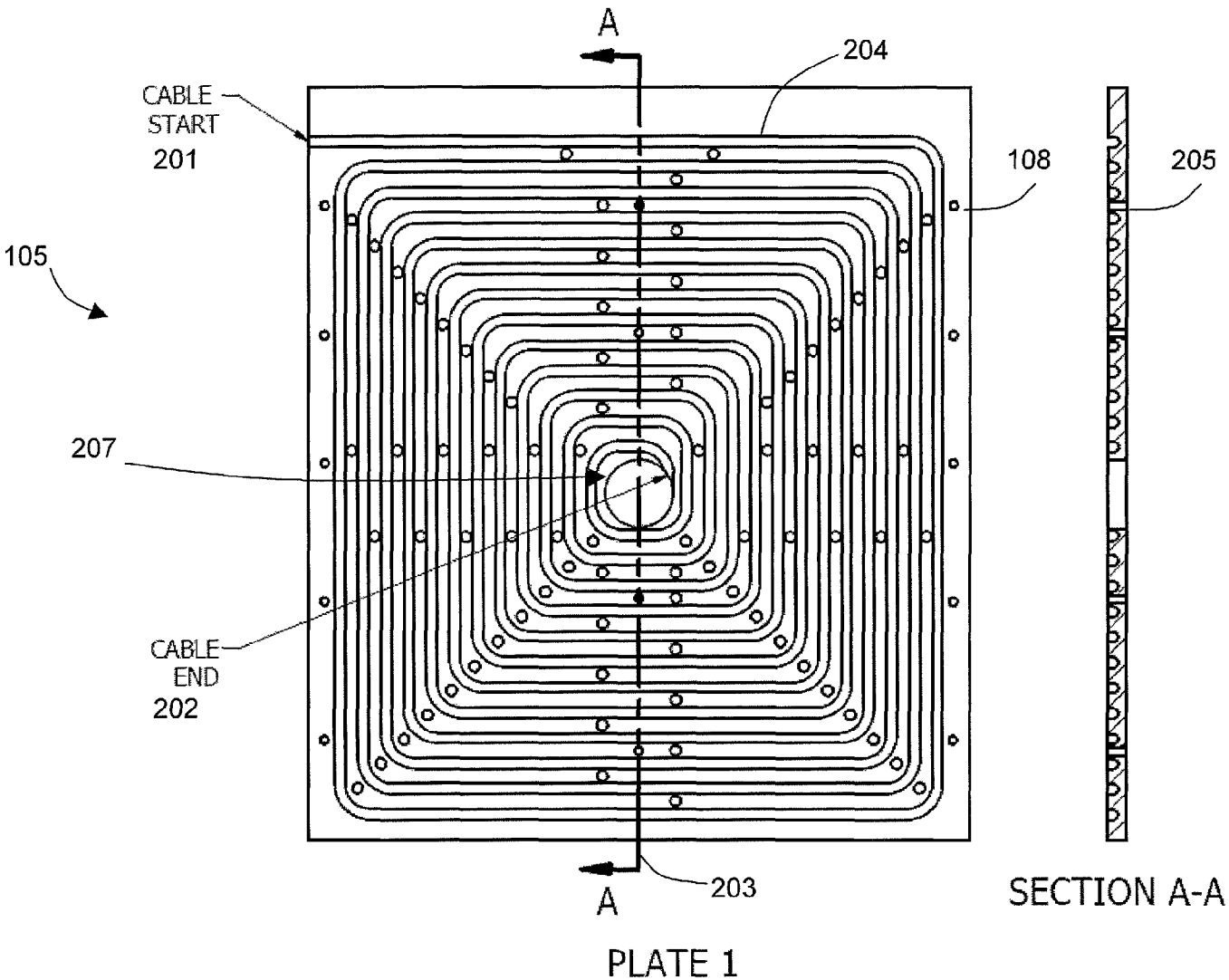
FIGS. 2A-2B are side and cross-sectional views, respectively, of a first plate according to an embodiment of the present invention.

FIG. 2A presents a schematic view of the grooved side of first plate 105. The start 201 of the groove 204 is at the perimeter of first plate 105, in order to allow entry of the absorptive cable from input connector 101 (not shown in FIG. 2). The groove 204 spirals inward toward the center of first plate 105, until reaching the end 202 on first plate 105. An opening 207 may be formed in the center of plate 105 to allow the cable to be to be routed to an adjacent plate on the non-grooved side of plate 105. If the cable is routed to an adjacent plate on the grooved side of plate 105, then opening 207 is not needed on plate 105 but may be needed on the adjacent plate. Opening 207 may be substantially circular or arc-like in order to allow the absorptive cable to pass between adjacent plates while in a substantially helical shape. A plurality of fasteners 108 secures first plate 105 to heat sink 103 and second plate 106. A secure mechanical fit ensures good heat conduction from first plate 105, and also minimizes any radiated emissions caused by the absorptive cable.

FIG. 2B presents a sectional view of first plate 105, taken along axis A-A 203. Groove 204 is sized to accommodate substantially the entire cross section of the absorptive cable. A plurality of fastener holes 205 allows for fasteners to attach first plate 105 to either heat sink 103 or to the next plate.

Figures 3A, 3B:
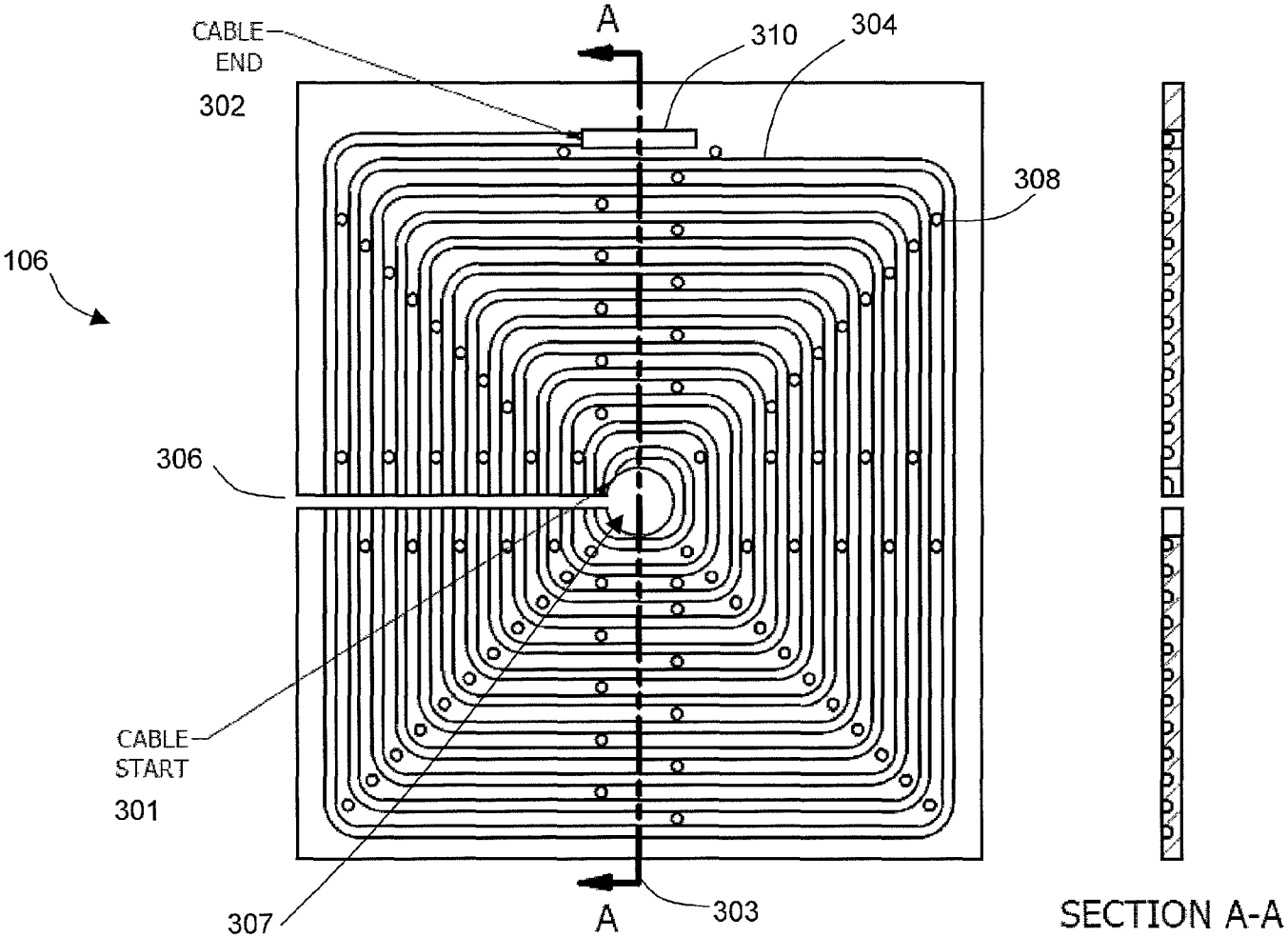
FIGS. 3A-3B are side and cross-sectional views, respectively, of a second plate according to an embodiment of the present invention.

FIG. 3A presents a schematic view of the grooved side of second plate 106. The start 301 of the groove 304 is near the center of second plate 106, in order to allow entry of the absorptive cable from the end 202 on first plate 105. Entry may be through opening 307 if the absorptive cable is provided from the non-grooved side of second plate 106. Opening 307 may be substantially circular or arc-like in order to allow the absorptive cable to pass between adjacent plates while in a substantially helical shape. The groove 304 spirals outward toward the perimeter of second plate 106, until reaching the end 302 on second plate 106. A second opening 310 may be foamed at the end 302 to allow the cable to be routed to an adjacent plate on the non-grooved side of plate 106. If the cable is routed to an adjacent plate on the grooved side of plate 105, then second opening 310 is not needed on plate 106 but may be needed on the adjacent plate. Second opening 310 may be substantially rectangular in order to allow the absorptive cable to pass between adjacent plates with little bending. Slit 306 is provided in order to provide ease of access to the absorptive cable during installation of the absorptive cable onto plates 105 and 106, so that the entire cable does not need to run through opening 207 or 307. A plurality of fasteners 308 secures second plate 106 to first plate 105 and third plate 107.

FIG. 3B presents a sectional view of second plate 106, taken along axis A-A 303. Groove 304 is sized to accommodate substantially the entire cross section of the absorptive cable.

Figures 4A, 4B:
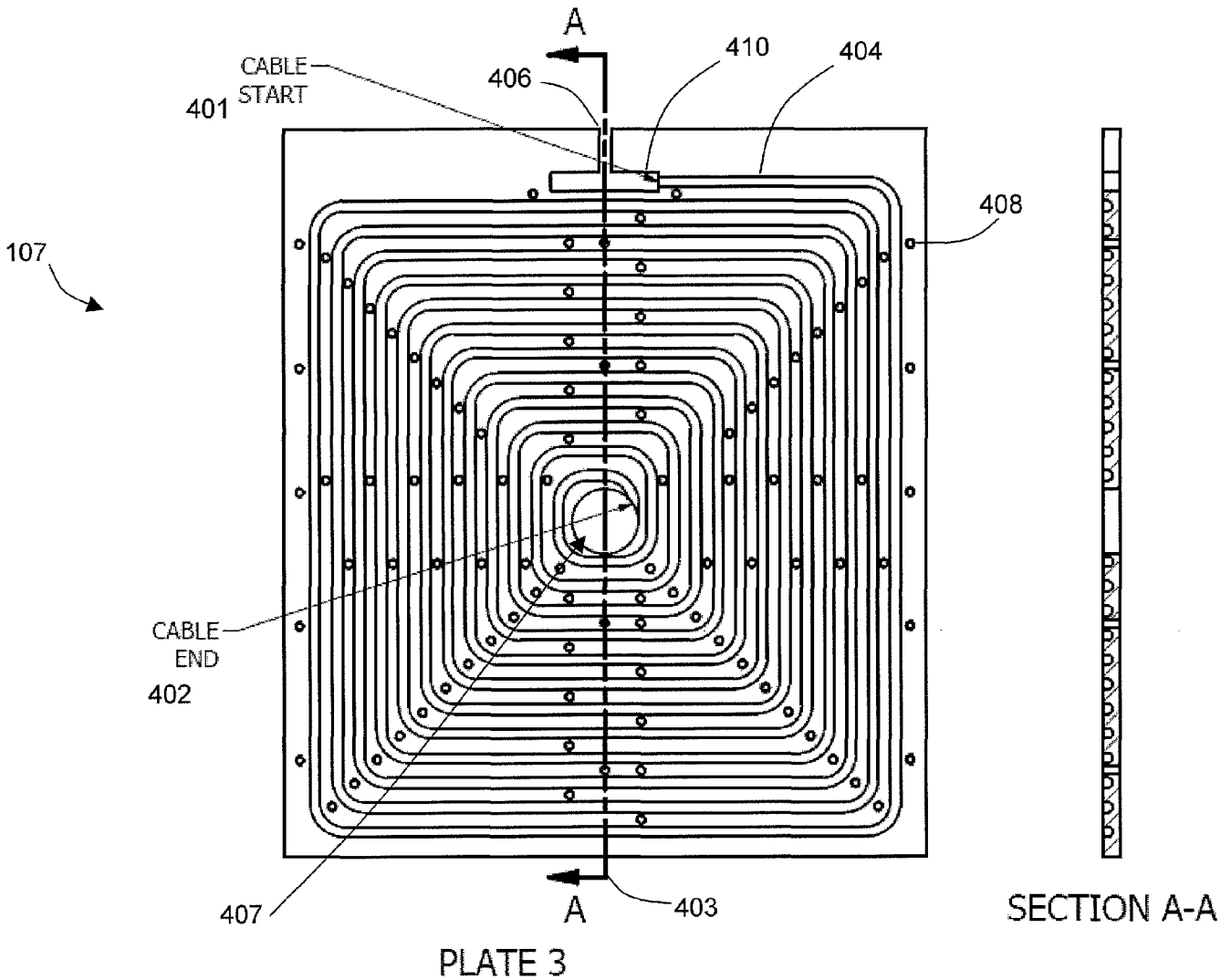
FIGS. 4A-4B are side and cross-sectional views, respectively, of a third plate according to an embodiment of the present invention.

FIG. 4A presents a schematic view of the grooved side of third plate 107. The start 401 of the groove 404 is near the perimeter of third plate 107, in order to allow entry of the absorptive cable from the end 302 on second plate 106. The groove 404 spirals toward the center of third plate 107, until reaching the end 402 on third plate 107. Slit 406 allows easy access to start 401 when installing the absorptive cable. Opening 410 on third plate may be provided in order to provide access to start 401 during cable installation. A plurality of fasteners 408 secures third plate 107 to second plate 106 and second heat sink 104. Opening 407 may be provided if the absorptive cable is provided to additional plates.

FIG. 4B presents a sectional view of third plate 107, taken along axis A-A 403. Groove 404 is sized to accommodate substantially the entire cross section of the absorptive cable.

Figure 5:
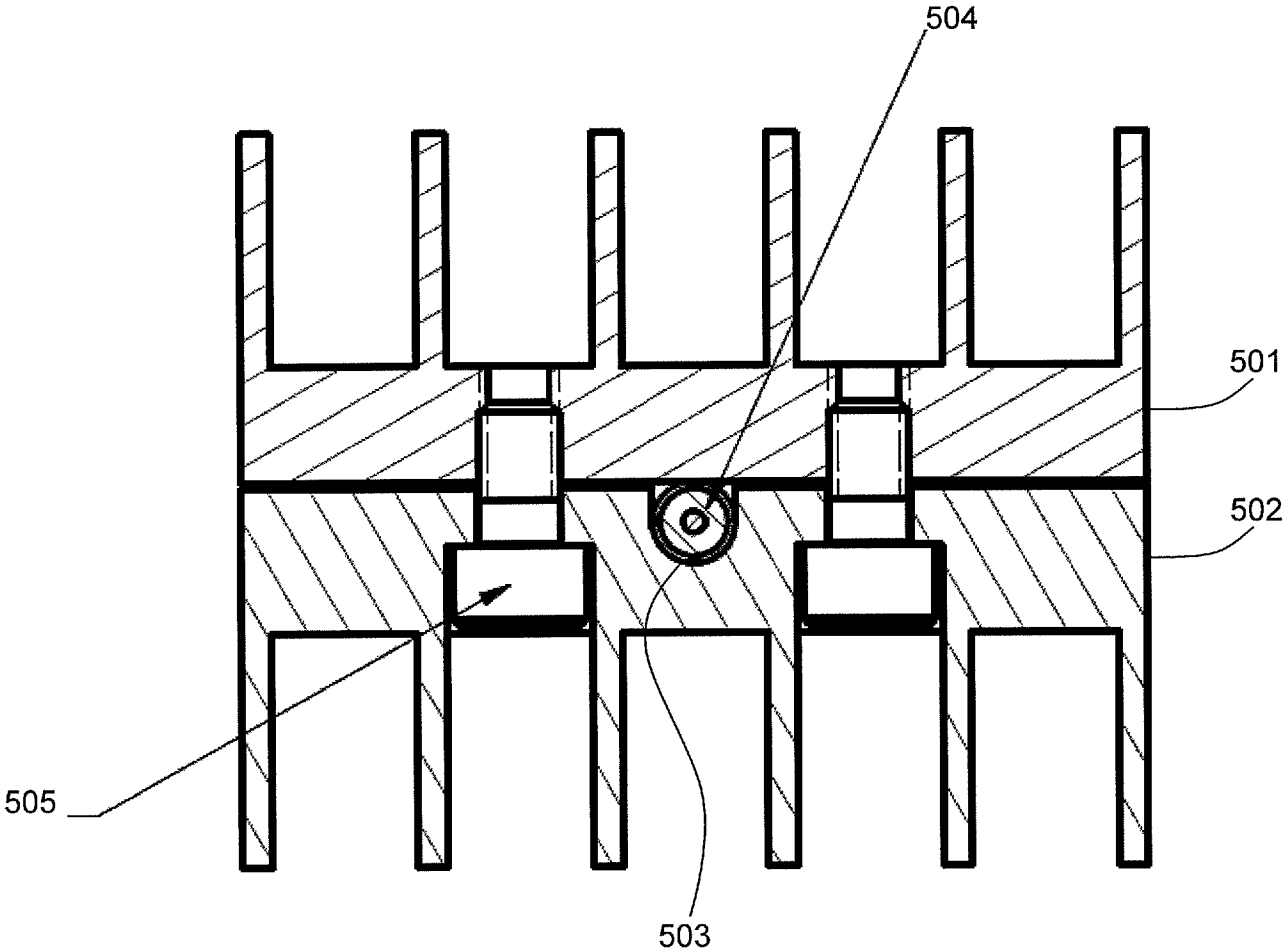
FIG. 5 is a cross-sectional view of an alternative embodiment of the present invention.

FIG. 5 presents a cross-sectional view of an alternate embodiment of an assembled microwave termination assembly, wherein no plates are situated between a first heat sink 501 and a second heat sink 502. Rather, a groove 503 to accommodate absorptive cable 504 is formed in at least one of first and second heat sinks 501 and 502. FIG. 5 illustrates second heat sink 502 configured with groove 503, however, groove 503 could also be configured into first heat sink 501. In another configuration, first and second heat sinks 501 and 502 may be cooperatively form a groove, such that a portion of the depth of groove 503 is formed in each of first and second heat sinks 501 and 502, and the entire groove is formed when first and second heat sinks 501 and 502 are assembled. Additionally, other configurations having multiple grooves formed in the heat sinks 501 and 502 can be implemented.

Figure 6:
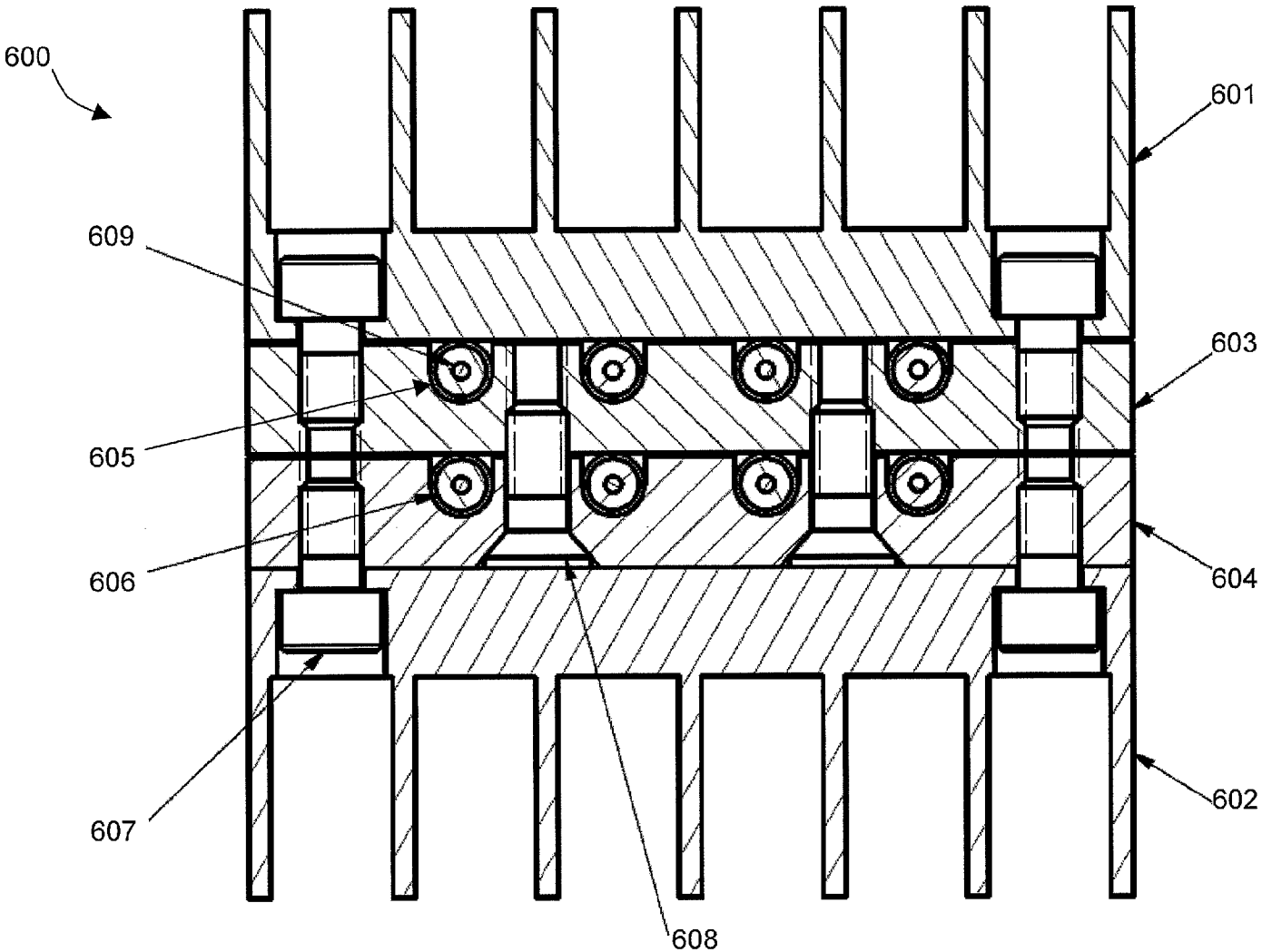
FIG. 6 is a cross-sectional view of an alternative embodiment of the present invention.

FIG. 6 presents a cross-sectional view of an alternate embodiment of an assembled microwave termination assembly 600, wherein only a first plate 603 and a second plate 604 are situated between a first heat sink 601 and a second heat sink 602. Groove 605 is formed directly into first plate 603, and groove 606 is formed in second plate 604. Grooves 605, 606 are formed similarly to grooves 204, 304 on plates 105, 106 of FIG. 2A, 3A. An absorptive cable 609 is disposed within grooves 605, 606. A plurality of fasteners 607 holds together the assembly 600. Optionally, a second plurality of fasteners 608 may be used to attach plates 603, 604 to each other. In another configuration, grooves 605, 606 can be formed on the opposite sides of either or both of first and second plates 603, 604 from that shown in FIG. 6, or first and second heat plates 603, 604 could cooperatively form a groove, such that approximately half of the depth of groove 606 is formed in each of first and second heat plates 603, 604, and the entire groove 606 is formed when first and second heat plates 603, 604 are assembled.

Figure 7B:
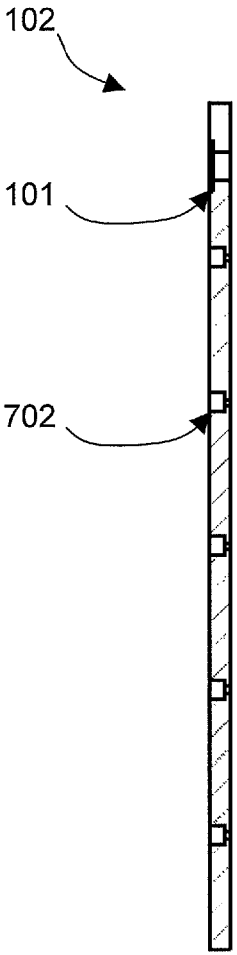
FIGS. 7A-7B are front and cross-sectional views, respectively, of a connector plate according to an embodiment of the present invention.
Figure 7A:
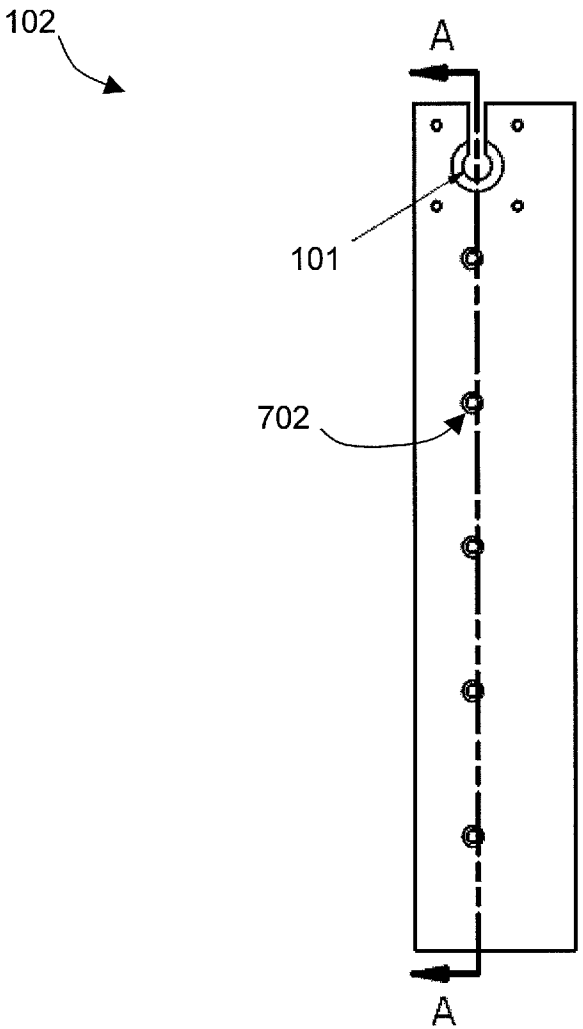

FIG. 7A illustrates a front view of the connector plate 102, and FIG. 7B illustrates a cross-sectional view taken along axis A-A of connector plate 102. Input connector 101 provides the interface to the power absorptive cable (not shown in FIG. 7A-B). A number of fasteners 701 attaches the connector plate 101 to the remainder of the termination assembly.

Assembly of microwave termination 100 includes placing the absorptive cable within the exposed channel of at least a first plate or heat sink Care must be taken not to deform the cable beyond the minimum bend radius. If needed, in order to provide a predetermined amount of microwave energy termination capacity, then a next section that is matched to the first section is attached and secured to the first section, such that the channel is formed between the sections, and the absorptive cable is situated in the channel. The channel of microwave termination 100 will substantially conform to the surface of the absorptive cable. Precision machining may be used to shape the portions of the sections that form the channel. Care is exercised to remove any metal particles created by the machining. A thermally conductive heat sink grease may be provided between the absorptive cable and the channel in order to improve the thermal coupling of the absorptive cable to the plates (if provided) and heat sinks. The heat sink grease will also mitigate stress in the absorptive cable and the plates (if provided) and heat sinks caused by any mismatch of thermal expansion coefficients as the temperatures of the absorptive cable and the plates (if provided) and heat sinks fluctuate.

When the plates (if provided) and heat sinks are assembled, a conforming channel is formed through microwave termination 100. The conforming shape allows for improved surface area contact per unit length between the plates (if provided) and heat sinks, and the absorptive cable situated within the channel. The total surface area contact is the product of the surface area contact per unit length, multiplied by the length of the absorptive cable within microwave termination 100.

The absorptive cable within microwave termination 100 is preferably a conventional coaxial cable having a solid inner conductor, a braided cylindrical outer conductor situated coaxially with the inner conductor, and a dielectric material separating the inner and outer conductors. The absorptive cable is designed for optimal PIM performance, and loss characteristics of the cable can be managed by specifying the length and the diameter of the cable.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include, but are not limited to, physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

It will be understood by those within the art that, in general, terms used herein, and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the re recitation of "two recitations," without other modifiers, typically means at least two recitations, or two or more recitations). Furthermore, in those instances where a convention analogous to "at least one of A, B and C," etc. is used, in general such a construction is intended in the sense one having skill in the art would understand the convention (e.g., "a system having at least one of A, B and C" would include but not be limited to systems that have A alone, B alone, C alone, A and B together, A and C together, B and C together, and/or A, B and C together, etc.). In those instances where a convention analogous to "at least one of A, B or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references, including but not limited to patents, patent applications, and non-patent literature are hereby incorporated by reference herein in their entirety.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A termination configured to absorb high microwave power while generating low levels of passive intermodulation interference, the termination comprising:

a microwave cable having a first end and a second end providing an insertion loss from the first end to the second end;

a heat-dispersive element in thermal contact with at least a portion of the microwave cable;

a channel accommodating the microwave cable; and an input connector coupled to the first end of the microwave cable;

wherein the heat-dispersive element includes a first heat sink coupled to a second heat sink and at least one plate is disposed between the first and second heat sinks and includes a groove that forms at least a portion of the channel.

2. The termination of claim 1, wherein the groove in the at least one plate is in a quadrilateral spiral pattern.

3. A termination configured to absorb high microwave power while generating low levels of passive intermodulation interference, the termination comprising:

a microwave cable having a first end and a second end providing an insertion loss from the first end to the second end;

a heat-dispersive element in thermal contact with at least a portion of the microwave cable;

a channel accommodating the microwave cable; and an input connector coupled to the first end of the microwave cable;

wherein the heat-dispersive element includes a first heat sink coupled to a second heat sink and a plurality of plates are disposed between the first and second heat sinks, each plate including a respective groove forming at least a portion of the channel accommodating the microwave cable.

4. The termination of claim 3, wherein the plurality of plates are adjacent to one another.

5. The termination of claim 3, wherein at least one of the plurality of plates includes an aperture disposed at an end of the respective groove.

6. The termination of claim 3, wherein each respective groove is in a quadrilateral spiral pattern.

7. The termination of claim 6, wherein the quadrilateral spiral pattern includes rounded corners.

8. A termination configured to absorb high microwave power while generating low levels of passive intermodulation interference, the termination comprising:

a first heat sink;

a second heat sink coupled to the first heat sink;

at least one plate disposed between the first and second heat sinks;

a microwave cable having a first end and a second end providing an insertion loss from the first end to the second end;

a channel accommodating the microwave cable; and an input connector coupled to the first end of the microwave cable;

wherein the at least one plate includes a groove that forms at least a portion of the channel.

9. The termination of claim 8, wherein the groove is in a quadrilateral spiral pattern.

10. The termination of claim 8, further comprising a plurality of plates disposed between the first and second heat sinks, each plate including a respective groove that forms at least a portion of the channel.

11. The termination of claim 10, wherein the plurality of plates are adjacent to one another.

12. The termination of claim 10, wherein at least one of the plurality of plates includes an aperture at an end of the respective groove.

13. The termination of claim 10, wherein each respective groove is in a quadrilateral spiral pattern.

14. The termination of claim 13, wherein the quadrilateral spiral pattern includes rounded corners.

15. A termination configured to absorb high microwave power while generating low levels of passive intermodulation interference, the termination comprising:

a first heat sink coupled to a second heat sink;

a microwave cable having a first end and a second end;

a first plate and a second plate disposed between the first and second heat sinks, the first plate having a groove in a quadrilateral spiral pattern to accommodate at least a portion of the microwave cable, the groove extending from a first end disposed near an edge portion of the first plate and spiraling in to an opening disposed at a center of the first plate, the microwave cable passing through the opening to the second plate, the second plate having a groove in a quadrilateral spiral pattern to accommodate at least a portion of the microwave cable, the groove extending from a first end disposed at a center of the second plate and spiraling out to an edge portion of the second plate; and an input connector coupled to the first end of the microwave cable.

* * * * *